US006451133B1

(12) United States Patent
Frodigh et al.

(10) Patent No.: US 6,451,133 B1
(45) Date of Patent: Sep. 17, 2002

(54) STAINLESS STEEL FOR USE IN SEAWATER APPLICATIONS

(75) Inventors: Johan Frodigh; Pasi Kangas, both of Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/807,931

(22) PCT Filed: Oct. 25, 1999

(86) PCT No.: PCT/SE99/01901

§ 371 (c)(1),
(2), (4) Date: Jun. 29, 2001

(87) PCT Pub. No.: WO00/28101

PCT Pub. Date: May 18, 2000

(30) Foreign Application Priority Data

Oct. 23, 1998 (SE) ..... 9803633

(51) Int. Cl.[7] ..... C22C 38/22
(52) U.S. Cl. ..... 148/325; 148/327
(58) Field of Search ..... 148/325, 327

(56) References Cited

U.S. PATENT DOCUMENTS 4,765,953 A 8/1988 Hagenfeldt et al.
5,582,656 A 12/1996 Kangas et al.
5,716,466 A * 2/1998 Yamaoka et al. ..... 148/325
6,312,532 B1 * 11/2001 Kangas ..... 148/325

FOREIGN PATENT DOCUMENTS

JP 50-4172 * 2/1975 ..... C22C/38/58

* cited by examiner

*Primary Examiner*—Deborah Yee
(74) *Attorney, Agent, or Firm*—Burns, Doane, Swecker & Mathis, L.L.P.

(57) ABSTRACT

A duplex ferritic-austenitic stainless steel alloy provided for seawater applications includes, in weight %: C maximum 0.05; Si maximum 0.8; Mn 0.03–4; Cr 28–35; Ni 3–10%, Mo 1.0–4.0; N 0.2–0.6; Cu maximum 1.0; W maximum 2.0; S maximum 0.010; Ce maximum 0.2; and the balance Fe together with normally occurring impurities and additives, wherein the ferritic content is 30–70 volume %, the alloy composition has a PRE-value higher than 42, and the PRE-value is at least 40 in both the ferritic and austenitic phases. A method is also provided which includes: providing a duplex ferritic-austenitic stainless steel alloy with the above-noted composition, forming a component with the alloy, and contacting the component with seawater. In preferred embodiments, the component comprises at least one of tubes, bars, heavy castings, forging, plates, wire or strip.

17 Claims, 8 Drawing Sheets

STAINLESS STEEL FOR USE IN SEAWATER APPLICATIONS

FIELD OF THE INVENTION

The present invention provides a ferritic-austenitic stainless steel provided for seawater applications and use of this ferritic-austenitic stainless steel in seawater applications and nearby areas, where especially favorable properties for the steel have been attained.

BACKGROUND OF THE INVENTION

Ferritic-austenitic (duplex) stainless steels are widely used today as construction material in a number of industries. Duplex steels are often developed for especially favorable use in special areas. For example, the duplex steel SAF 2507 (UNS S 32750), which is alloyed with 25% Cr, 7% Ni, 4% Mo and 0.3% N and which is described in the Swedish Patent Application SE-A-453 838, concerned to be especially resistant against chloric induced corrosion and finds therefore applications as construction material if the process solution contains chlorides or if the material will be exposed for seawater or chlorine containing cooling water, for example in heat exchangers.

In U.S. Pat. No. 5 582 656 (SE-A-501 321) duplex steels are described, which contain a maximum of 0.05 weight % C, a maximum of 0.8 weight % Si, 0.3–4 weight % Mn, 28–35 weight % Cr, 3–10 (3–7) weight % Ni, 1.0–3.0 (1.0–4.0) weight % Mo, 0.30–0.55 weight % N, a maximum of 1.0 weight % Cu, a maximum of 2.0 weight % W, 0.010 weight % S and 0.2 weight % Ce, and a balance of Fe together with normally occurring impurities and additives, and wherein the ferrite content of the steel makes 30–70 volume %.

A purpose of the present invention is to provide duplex steel for use within seawater applications.

As described in SE-A-453 838 the composition of the alloy is not the most important factor to provide such steel. The balance between the different components of the alloy and structural factors is more important. Furthermore it is well-known from this patent that high amounts of, for example, chromium, improve the tendency of precipitation of intermetallic compounds so strong, that problems in manufacturing and in relation with welding could occur. A high amount of nitrogen is desired in order to stabilize the alloy against precipitation of intermetallic phases and improvement of the corrosion resistance, but is restricted by the limited solubility in the melt, which causes precipitation of chromium nitrides. By these reasons the content of chromium in this alloy will be restricted to a maximum of 7% and the content of nitrogen to 0.25–0.40%.

SUMMARY OF THE INVENTION

Surprisingly, some of the alloys described in U.S. Pat. No. 5,582,656 have been found to possess favorable and, in certain cases, particularly good properties as construction material in the field of seawater applications. This result is surprising since these alloys have a high content of chromium and high content of nitrogen that is over the upper limit that taught by to SE-A-453 838 as avoiding precipitation. Especially good properties will be achieved if the PRE-value of the steel is at least 40.

The invention provides consequently to a steel containing a maximum of 0.05 weight % C, a maximum of 0.8 weight % Si, 0.3–4 weight % Mn, 28–35 weight % Cr, 3–10 weight % Ni, 1.0–4.0 weight % Mo, 0.2–0.6 weight % N, a maximum of 1.0 weight % Cu, a maximum 2.0 weight % W, a maximum of 0.010 weight % S and a maximum of 0.2 weight % Ce, and the balance Fe together with normally occurring impurities and additives, at which the ferritic content makes 30–70 volume % and the PRE-value is at least 40.

None of the steel grades, that are specifically described in U.S. Pat. No. 5,582,656 or SE-A-501 321 provides a PRE-value over 40 in both the ferritic and the austenitic phase. Most of the embodiments provide a PRE-value under 40 even calculated on the hole composition.

BRIEF DESCRIPTION OF THE DRAWING FIGURES

DETAILED DESCRIPTION OF THE INVENTION

Figure 1:
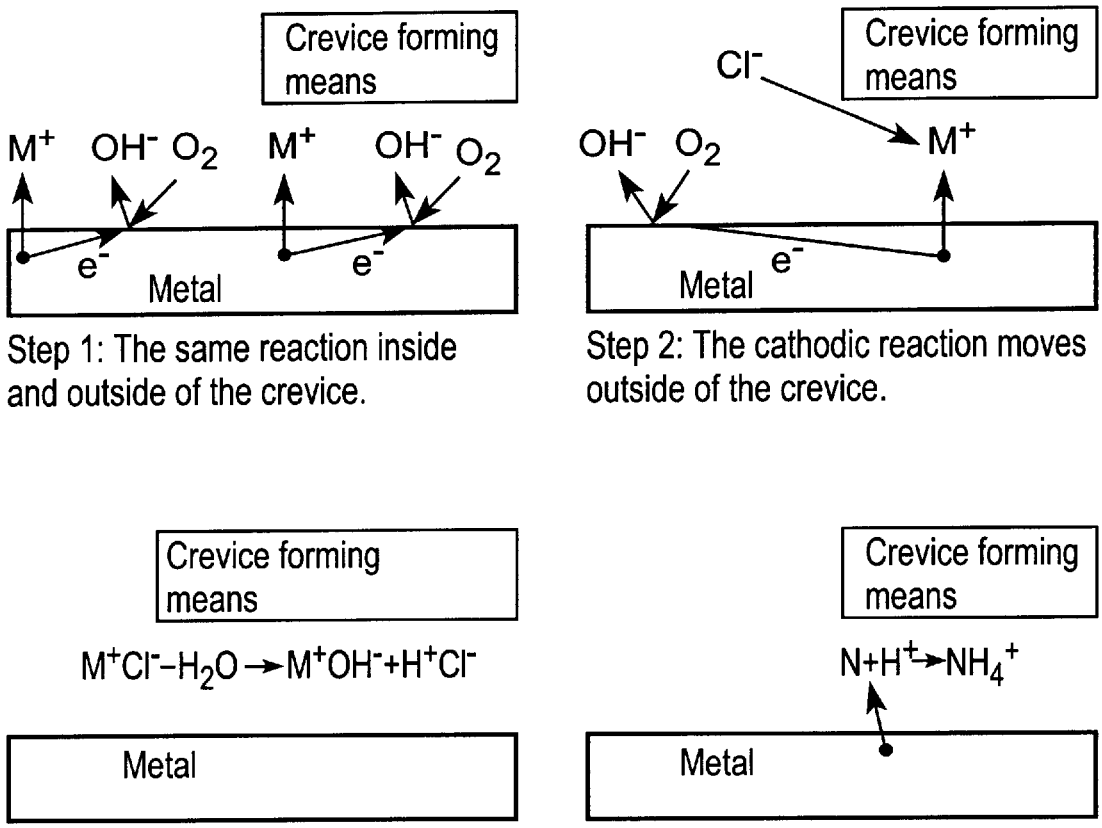
FIG. 1 is schematic illustration of crevice corrosion.

Before describing the particular features and aspects of the present invention, it should be noted that seawater is not the same all over the world. For instance, the total amount of dissolved salt can range from approximately 8000 mg/l (ppm) in the Baltic Sea to ca 7.5 times this amount in the Persian Gulf. The total amount of salt that artificial seawater is based on is 35 000 mg/l, which can be considered as a typical amount for seawater. In table 1 the mixture of artificial seawater is shown. The main share of all salt in seawater is NaCl. Often, seawater contains also sand and other solid particles.

The following table shows the mixture of the artificial seawater used for testing material suitability for seawater applications.

TABLE 1

Mixture of artificial seawater

| Element | Concentration (mg/l) | % of the total amount of salt |
|---|---|---|
| Chlorine | 18980 | 55.0 |
| Bromine | 65 | 0.2 |
| Sulphate | 2649 | 7.7 |
| Bicarbonate | 140 | 0.4 |

TABLE 1-continued

| Mixture of artificial seawater | | |
|---|---|---|
| Element | Concentration (mg/l) | % of the total amount of salt |
| Fluorine | 1 | 0.0 |
| Boric acid | 26 | 0.1 |
| Magnesium | 1272 | 3.7 |
| Calcium | 400 | 1.2 |
| Strontium | 13 | 0.0 |
| Potassium | 380 | 1.1 |
| Natrium | 10560 | 30.6 |
| Total | 34486 | 100.0 |

The primary factors which determine the corrosivity of seawater are: content of chloride, index of pH, temperature, oxidizing ability, biological activity and flow rate. Even impurities in the water can affect the corrosivity. The temperature of the seawater is strongly variable depending upon where one is situated and at what depth the water is taken. The pH-value of seawater is approximately 8.

A steel according to the invention comprises a maximum of 0.05 weight % C, a maximum of 0.8 weight % Si, 0.3–4 weight % Mn, 28–35 weight % Cr, 3–10 weight % Ni, 1.0–4.0 weight % Mo, 0.2–0.6 weight % N, a maximum of 1.0 weight % Cu, a maximum of 2.0 weight % W, a maximum of 0.010 weight % S and a maximum of 0.2 weight % Ce.

The PRE-value, i.e. (% Cr)+3.3×(% Mo)+16×(N), should be at least 40 in the total composition, preferably at least 42 in the total composition. Further, each phase should exhibit a PRE-value over 40, preferably at least 41.

In U.S. Pat. No. 5,582,656 it is specified that the additional alloying elements should fulfill the expression % Cr+0.9% Mn+4.5% Mo-12.9% N<35 in order to minimize the risk for precipitation of intermetallic phases during the production. It has surprisingly been determined that one could hold the above-mentioned value in the present steel at 35 or more, but still achieve the essential properties which are necessary to be able to use the steel in seawater applications. It is advantageous to hold the above-mentioned value at 35 or more, as it is easier to obtain a higher PRE value. Thus, the steel of the present invention preferably fulfills the expression % Cr+0.9% Mn+4.5% Mo-12.9% N>35 to obtain a sufficiently high PRE value. Preferably, the value of % Cr+0.9% Mn+4.5% Mo-12.9% N is at most 40, and more preferably at most 38.

The preferred content of Mn is 0.3–3.0%, and the content of S is suitably maximum 0.005%. Consequently, a reduced amount of MnS-slag will be obtained in the material. Those slags easily initiate pitting in seawater-environment, thus it is preferable to keep this type of slag on a low level in a "seawater-steel".

The content of Mo is preferably 1.5–4.0%. This gives a higher minimum-level for the PRE-value in the steel. However, due to the risk of precipitation of intermetallic phases, the content of Mo should be restricted to a maximum of 3.0%, preferably to a maximum of 2.5%.

For the maintenance of a sufficient high content of Cr in the austenitic phase, and so that the PRE-value should be over 40, the lowest total content of Cr is suitably approximately 29%. In view of the risk of precipitation of intermetallic phases the content of Cr should preferably be maximum 33%.

Nitrogen increases the relative content of chromium and molybdenum in the austenitic phase. Therefore, the content of N should be at least 0.30%, but preferably no less than 0.36%. High contents of N could cause formation of voids under welding and therefore the alloy according to the invention should contain maximum of 0.55% Nitrogen.

The content of Ni is preferably maximum 8%, and the minimum content is preferably 5%.

An important property for seawater applications is high strength, i.e.—high yield point and high fatigue limit. By providing a material with high strength, you can use poorer material (e.g.—thinner wall thickness for tubes), and reduce weight. Often, it is important to keep the weight of a construction material for seawater applications low, because the construction could often be situated on floating plants, such as boats, oil platforms and so on, thus more available buoyancy to transport goods would be used by heavier materials.

Another important property of material for seawater applications is good corrosion resistance in Cl-containing environments. The types of corrosion which can easily be initiated in Cl-containing environments are pitting corrosion, crevice corrosion and stress corrosion cracking. Pitting and crevice corrosion of the material could be avoided if the "PRE-value" for the same is sufficiently high. The PRE-value is defined as PRE=(% Cr)+3.3×(% Mo)+16×(% N). In order to have a good corrosion resistance in seawater the PRE-value should be higher than 40 for duplex steel. As apparent from the definition, a high PRE-value could be based on whether a high content of Cr, Mo or N. It is well-known that a high content of Mo gives a less structurally stable material, related to the precipitation of the sigma phase. It is well-known that a high content of N gives a more structurally stable material. Therefore it is more suitable to base the high PRE-value on a high content of N or Cr, rather than a high content of Mo.

At risk for crevice corrosion it is also desirable with a high content of N, because this neutralizes $H^+$-ions, which will be formed in the cleft and by that avoid the decreasing pH-value that could make the environment worse. The crevice corrosion course is schematically shown in the FIG. 1.

The third type of corrosion, which can appear in Cl-containing environments, is stress corrosion cracking. This appears mainly in austenitic stainless steel and is treacherous, because it can develop very fast. It is well known that duplex steels have very good stress corrosion cracking resistance because of the advantageous synergistic effect between the ferritic and the austenitic phase in the material.

Another property, that is important in some cases of seawater applications, is the erosion corrosion resistance of the alloy. The erosion corrosion can be defined as acceleration of the corrosion course as a consequence of rapidly streaming media, which sometimes can contain solid particles. A strong contributing factor for erosion corrosion is the turbulent flow in tubes (in contrast to laminar flow). Turbulent flow can be increased by high velocity flow restrictions in the tube, e.g.—valves in the tube, sharp bends, etc.

A last factor to be taken into consideration is of course the price of the alloy. For seawater applications it should be desirable with a material that has a good corrosion resistance, especially in Cl-containing environments, and at the same time has the highest possible strength.

The steel according to the invention has a very high strength, i.e.—yield point in tension (0.2) ≧650 MPa. In comparison with other typical steel grades for seawater applications this is considerable higher (SAF 2507: yield point in tension=550 MPa; 6Mo-steel: yield point in tension=300 MPa). Due to its high strength, a steel according to the present invention can be used in the form of a tube with considerable thinner wall thicknesses than tubes formed from conventional materials.

However, the high strength is not coincident for all steels described in U.S. Pat. No. 5,582,656. For example, there is steel described therein (no. 10) with a yield point in tension of only 471 MPa (Table 1 and 2). However, this steel has a PRE-value at only 35.6 and is, consequently, not within the scope of the present invention.

Figure 2:
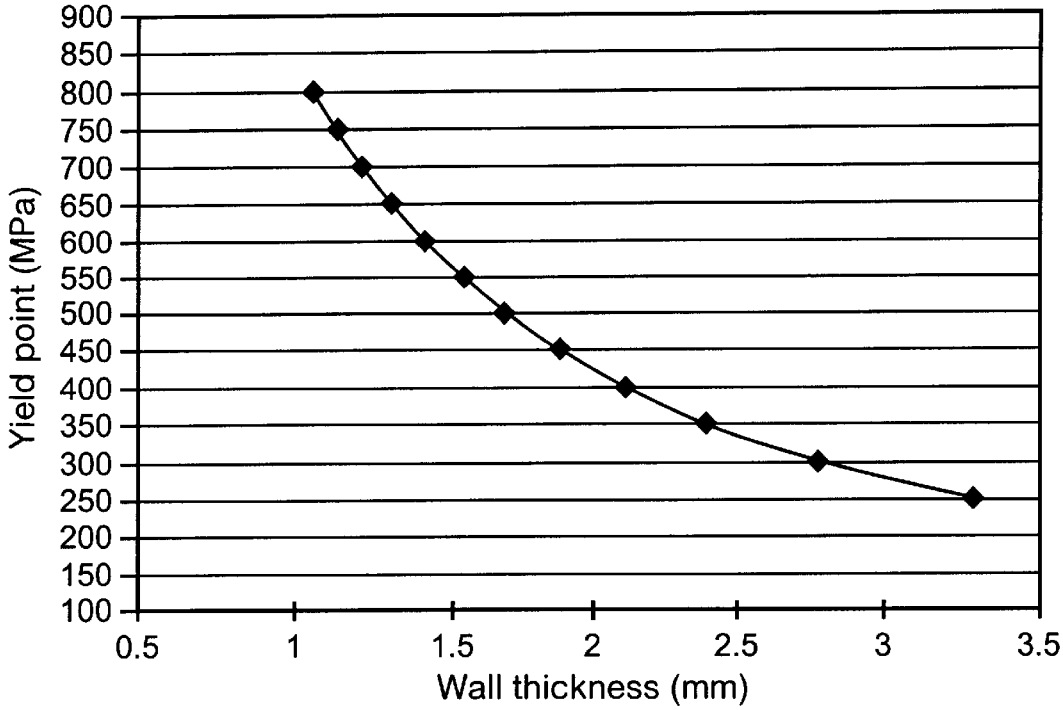
FIG. 2 is a plot of yield point vs. wall thickness necessary to withstand a certain internal pressure.

FIG. 2 shows the effect of the yield point in tension on the wall thickness which is necessary to withstand a certain inner pressure (according to the formula in the Swedish conduit standard 1978, RN78). As evident from FIG. 2, increasing the yield point in tension from 550 MPa to 650 MPa allows a reduction of the wall thickness of 15%, and in connection with this, a reduction of the total tube weight in the range. A corresponding comparison between 300 MPa and 650 MPa reduces about 50% of the weight.

The pitting and crevice corrosion of the presented steel is good. This depends on that the PRE value of the alloy is over 40. More precisely, the PRE value is around 42, which is the same level as for the established "seawater steels" SAF 2507 (UNS S 32750) and austenitic stainless steel of the type 6-Mo.

Figure 3:
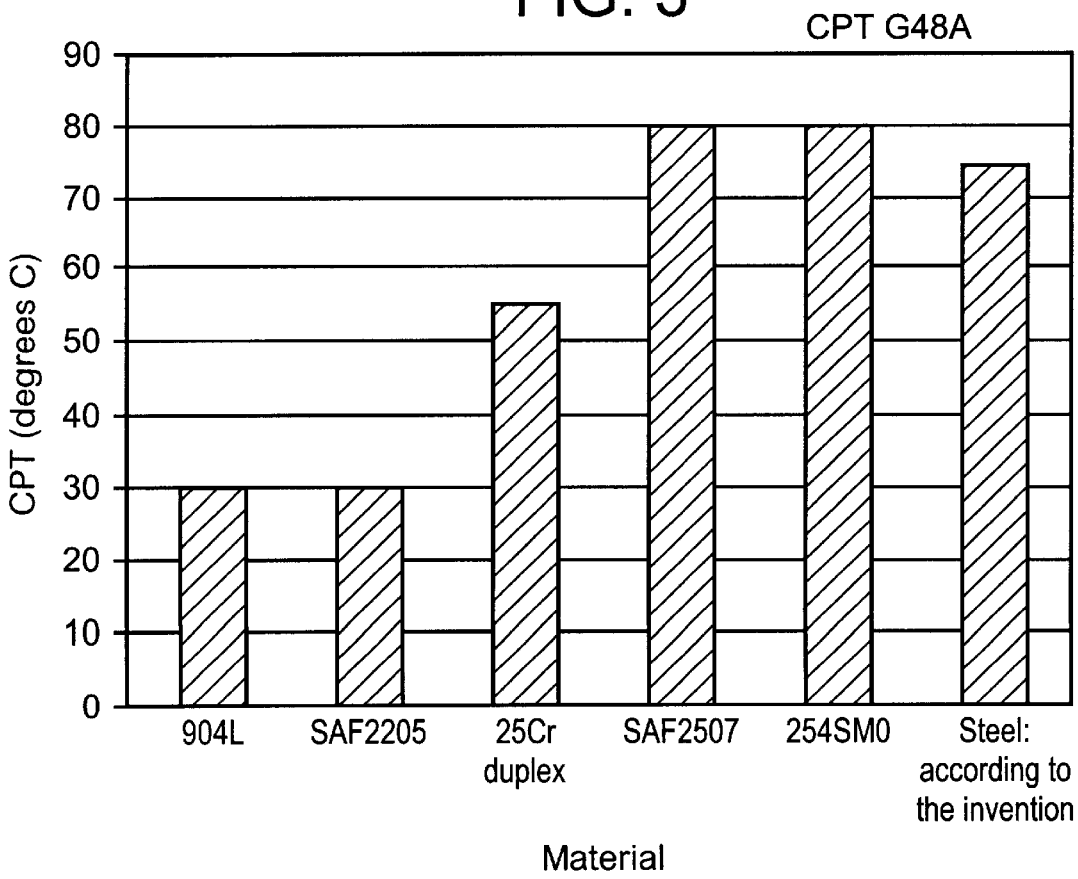
FIG. 3 is a graphical representation of critical pitting temperature (CPT) for various alloy compositions.

As an acceptance test for such a material, it is common to use tests for the pitting corrosion, which can be seen as an indicator for the seawater resistance. The most frequent method is to use the modified ASTM G48A-method, where a material is placed in a solution of 6% ferric chloride, whereafter the temperature is stepped with a 24-hour interval and the material will be inspected concerning to the pitting corrosion after every test period. The temperature where pitting corrosion occurs is called the critical pitting temperature (CPT). FIG. 3 shows the critical temperature for specimen of the materials 254 SMO, SAF 250, and a steel according to the invention. From this it can be concluded that all of these materials have high values for the critical pitting temperature, and for this reason it is probable that the materials have equivalent pitting corrosion resistance in seawater.

Corresponding testing in $FeCl_3$ can be made with applied crevice formers. A steel according to the invention has a critical crevice corrosion temperature of about 40° C. Even this could be seen as being at approximately the same level as for the established "seawater steels". The possibility the development of crevice corrosion after initiation could even be expected to be on a low level because of the high content of nitrogen in the alloy.

Figure 4:
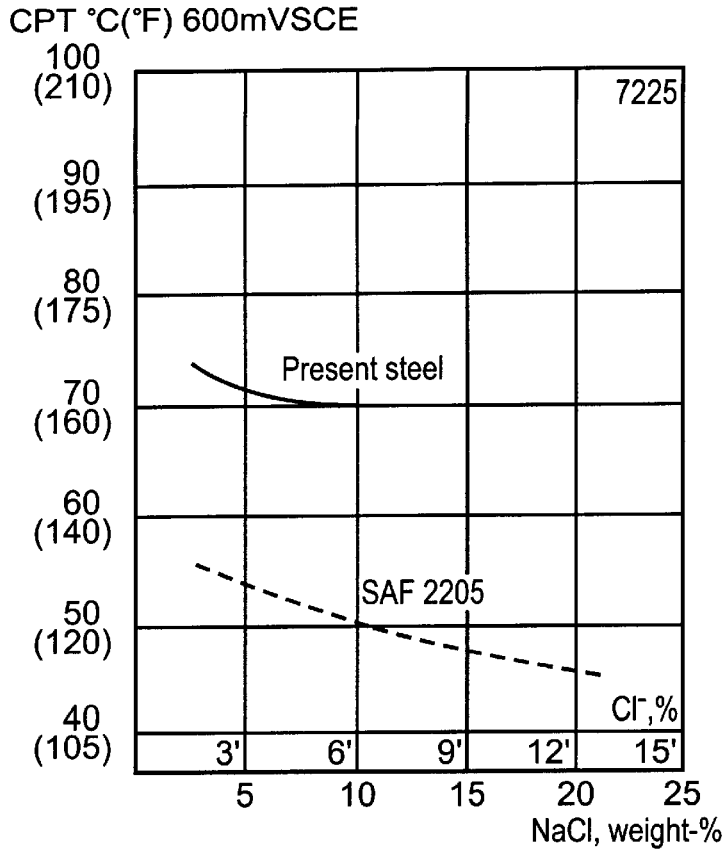
FIG. 4 is a graphical representation of CPT vs. weight % NaCl content comparing a steel of the present invention with a conventional steel.

Another method to determine the material's pitting resistance that is used is an electrochemical test with a steadily applied potential on the material. In order to simulate chlorinated seawater, which is a very aggressive solution, it is tested at 600 mV/SCE. The result of this testing of a steel according to the invention is shown in FIG. 4. As apparent, this steel passes 70° C. in this environment, independent of the content of NaCl.

As mentioned earlier, the reason for good pitting and crevice corrosion resistance is a high PRE value. A comparison can be made with SAF 2507, which is optimized with respect to the PRE value so that the PRE value is equal in both phases. This result is obtained by alloying with a well-balanced composition of Cr, Mo and N, and 0.30% N gives balance between PRE in the ferritic and austenitic phase, when the content of chromium is 25% and the content of Mo is 4%. A PRE-value over 40 will then be achieved.

Figure 5:
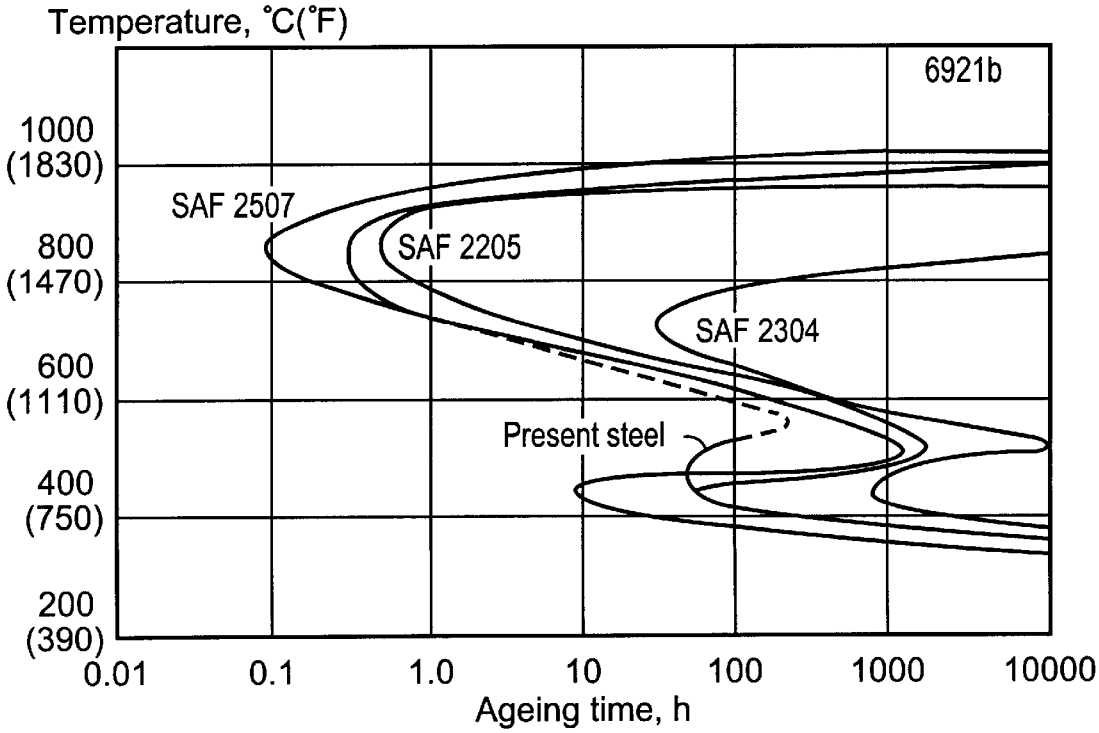
FIG. 5 is a TTT diagram comparing a steel of the present invention with conventional steels.

The steel according to the invention is based on the same presumptions, namely PRE-balance. But, according to the present invention, a higher content of Cr and a lower content of Mo is chosen, which makes it possible to alloy a higher content of N. Due to the fact that Mo is considerably more detrimental to structural stability than Cr, and also that the content of N is higher than in SAF 2507, a higher structural stability in the steel according to the invention is obtained with a sustained PRE-value in the phases (see FIG. 5 for TTT-curve).

Figure 6:
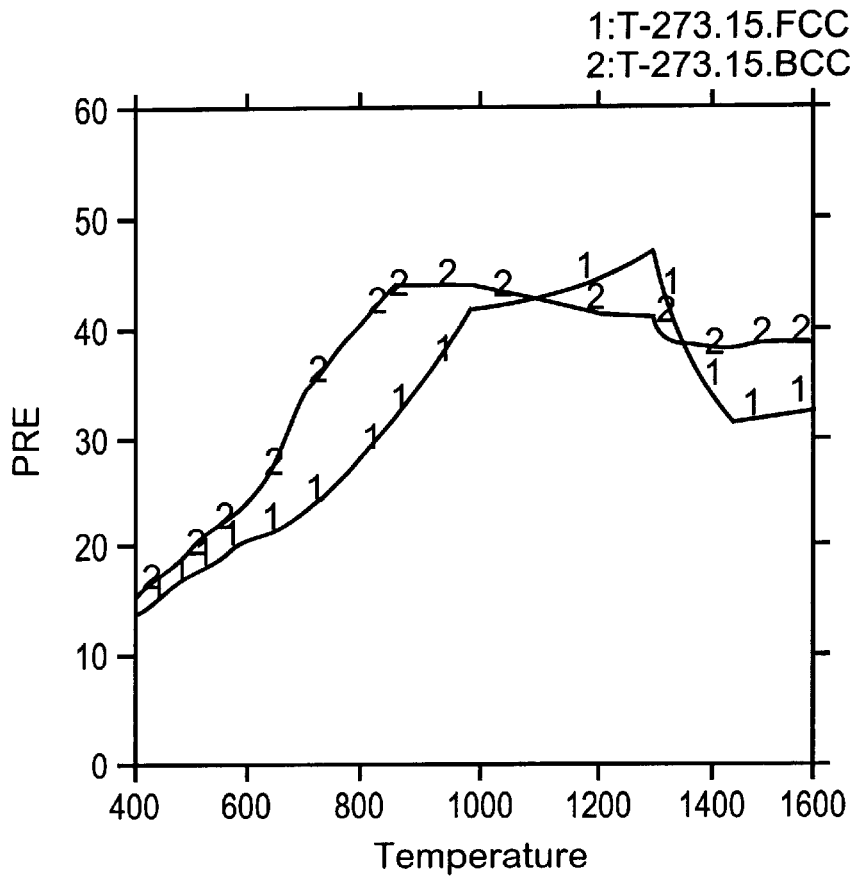
FIG. 6 is a plot of PRE values vs. temperature, comparing a BCC phase and a FCC phase of steel according to the present invention.

FIG. 6 shows the influence of temperature on the PRE value in ferritic (BCC) and austenitic (FCC) phases for the presented steel. PRE balance will be obtained at about 1080° C., which is the temperature at which the material is heat treated and the value of the PRE-value is over 40.

Figure 7:
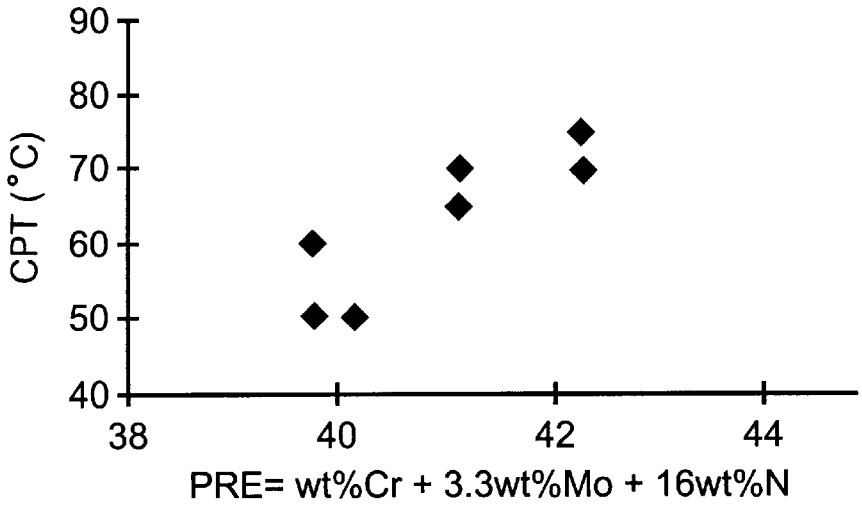
FIG. 7 is a plot of CPT vs. PRE values.

The importance of having a high PRE value in both the ferritic and austenitic phase is shown in FIG. 7, where the CPT according to ASTM G48A is shown as a function of PRE value for the somewhat weaker ferritic phase in some test variants of the steel according to the invention. A PRE-value over 40 in both phases should therefore be considered as fulfilled in connection with a CPT (G48A) of 75° C. for the final alloy.

Figure 8:
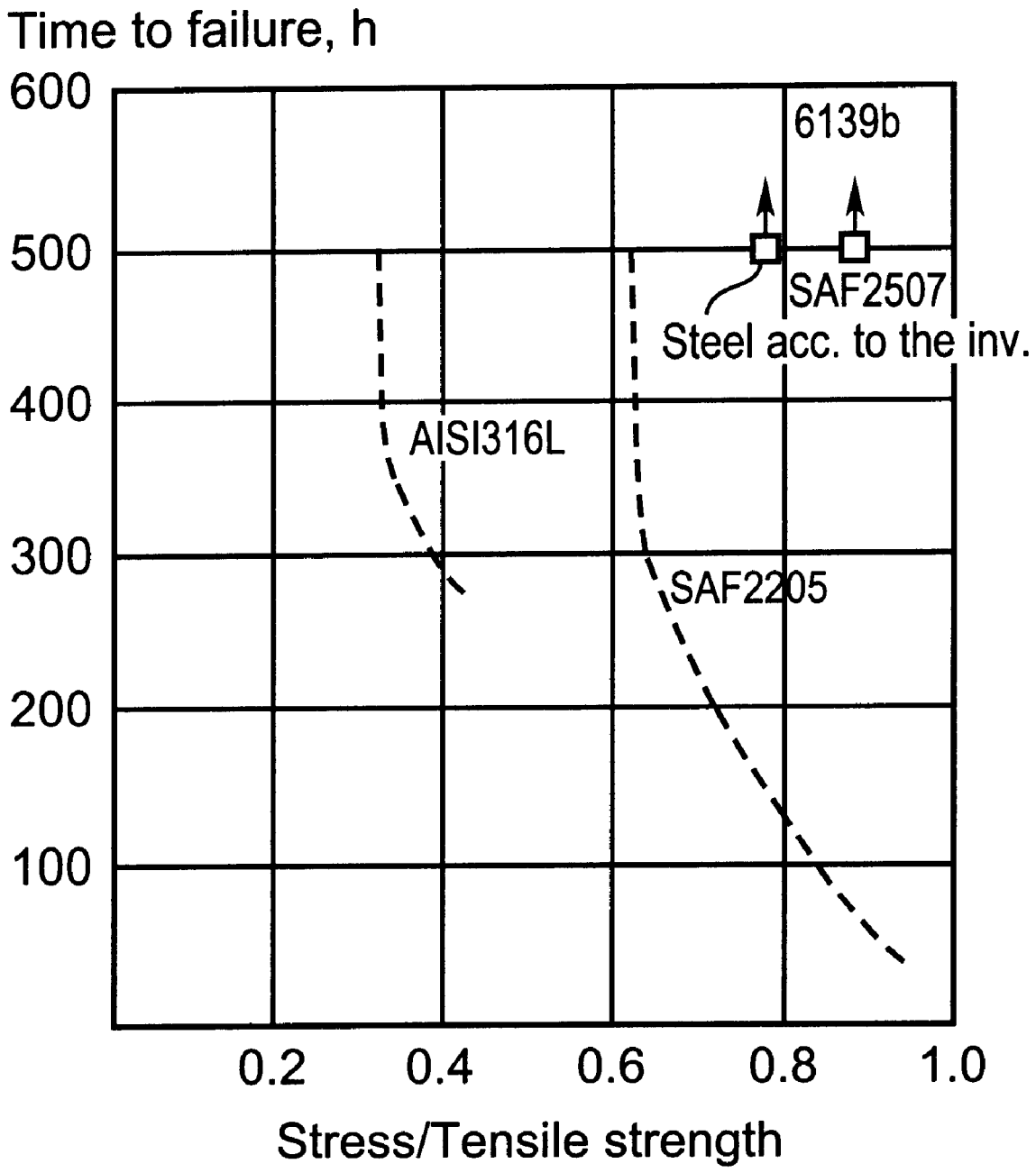
FIG. 8 is a plot of time to failure vs. stress/tensile strength, comparing a steel of the present invention with conventional steel.

As illustrated in FIG. 8, the stress corrosion resistance of the steel according to the invention is clearly greater than that of austenitic steels of type 316. It should be borne in mind that the duplex steels have a very high strength in absolute figures, which makes the percentage of the tensile strength which can be effectively utilized before stress corrosion occurs is very high for these steels.

According to the present invention, the impingement attack resistance of the steel is very high, with highest reliability, because of the high strength and the good resistance for duplex steels.

Cu-base alloys are materials that are often used in seawater. However, materials have the big disadvantage of being sensitive to impingement attacks. Other competing materials for seawater applications are Ti- and Ni-based alloys. However, these are considerable more expensive than the steel of the present invention.

The present invention will now be described by reference to the following examples, which are intended to be illustrative rather than restrictive.

EXAMPLE

In the following some embodiments of steels according to the invention will be described.

In the following Table 2 are compositions shown for five alloys according to the invention. These are the examples taken from a large number of different alloys which were produced and tested during the development of the present invention.

TABLE 2

[0055]

| Alloy | C | Si | Mn | Cr | Ni | Mo | N | Cu | S |
|---|---|---|---|---|---|---|---|---|---|
| 1 | 0.015 | 0.19 | 0.91 | 29.26 | 8.00 | 2.07 | 0.31 | 0.025 | 0.0043 |
| 2 | 0.016 | 0.16 | 1.01 | 28.81 | 7.48 | 2.50 | 0.37 | 0.035 | 0.0032 |
| 3 | 0.021 | 0.27 | 0.90 | 28.80 | 6.62 | 2.20 | 0.38 | 0.081 | 0.0010 |
| 4 | 0.015 | 0.15 | 1.00 | 29.01 | 6.66 | 2.51 | 0.40 | 0.037 | 0.0036 |
| 5 | 0.016 | 0.16 | 0.87 | 30.51 | 6.20 | 2.08 | 0.44 | 0.034 | 0.0042 |

Extruded bars were formed from alloy no. 1, 2, 4 and 5, the content of Cr, Ni, Mo and N measured in the austenitic and ferritic phases with the help of a step by step analysis in a microgroove. The result of those measurements is shown in the following Table 3.

TABLE 3

[0057]

| Alloy | Phase | Cr (%) | Ni (%) | Mo (%) | N (%) |
|---|---|---|---|---|---|
| 1 | Ferritic | 32.59 ± 0.48 | 5.47 ± 0.18 | 2.60 ± 0.14 | 0.00 ± 0.03 |
| | Austenitic | 27.88 ± 0.31 | 9.24 ± 0.20 | 1.58 ± 0.14 | 0.62 ± 0.03 |
| 2 | Ferritic | 31.78 ± 0.42 | 5.27 ± 0.32 | 3.16 ± 0.12 | 0.00 ± 0.02 |
| | Austenitic | 28.15 ± 0.48 | 8.48 ± 0.18 | 1.93 ± 0.08 | 0.75 ± 0.03 |
| 4 | Ferritic | 31.58 ± 0.34 | 4.65 ± 0.13 | 3.21 ± 0.20 | 0.01 ± 0.03 |
| | Austenitic | 28.88 ± 0.28 | 7.45 ± 0.15 | 1.93 ± 0.10 | 0.88 ± 0.04 |
| 5 | Ferritic | 32.31 ± 0.31 | 4.58 ± 0.13 | 2.40 ± 0.11 | 0.00 ± 0.03 |
| | Austenitic | 30.16 ± 0.25 | 6.99 ± 0.20 | 1.64 ± 0.13 | 0.98 ± 0.04 |

The PRE values, (% Cr)+3.3 (% Mo)+16 (% N), for the alloys were measured for each phase, and for the total composition, as shown in the following Table 4.

TABLE 4

PRE-values for austenitic and ferritic phase in test alloys

| Alloy | PRE (total composition) | Phase | PRE (for different phases |
|---|---|---|---|
| 1 | 41.1 | Ferritic | 41.2 |
| | | Austenitic | 43.0 |
| 2 | 43.0 | Ferritic | 42.3 |
| | | Austenitic | 46.5 |
| 4 | 43.7 | Ferritic | 42.3 |
| | | Austenitic | 49.3 |
| 5 | 44.4 | Ferritic | 40.2 |
| | | Austenitic | 51.3 |

As evident from the above, the PRE value is higher than 40 in both the austenitic and the ferritic phase in all alloys. This is a condition for a good corrosion resistance in seawater.

The PRE-value in the respectively phase could also be calculated by the help of the computer-program "Thermo-Calc" based on the composition. This calculation is made for alloy 1 at different temperatures and is illustrated in FIG. 6.

The heat-treatment temperature of about 1080° C. that renders the same PRE value in both phases comes from calculated values. Thus, as would be understood by those in the art, is only approximate. Therefore, actual values for PRE could deviate a little from equilibrium.

Figure 9:
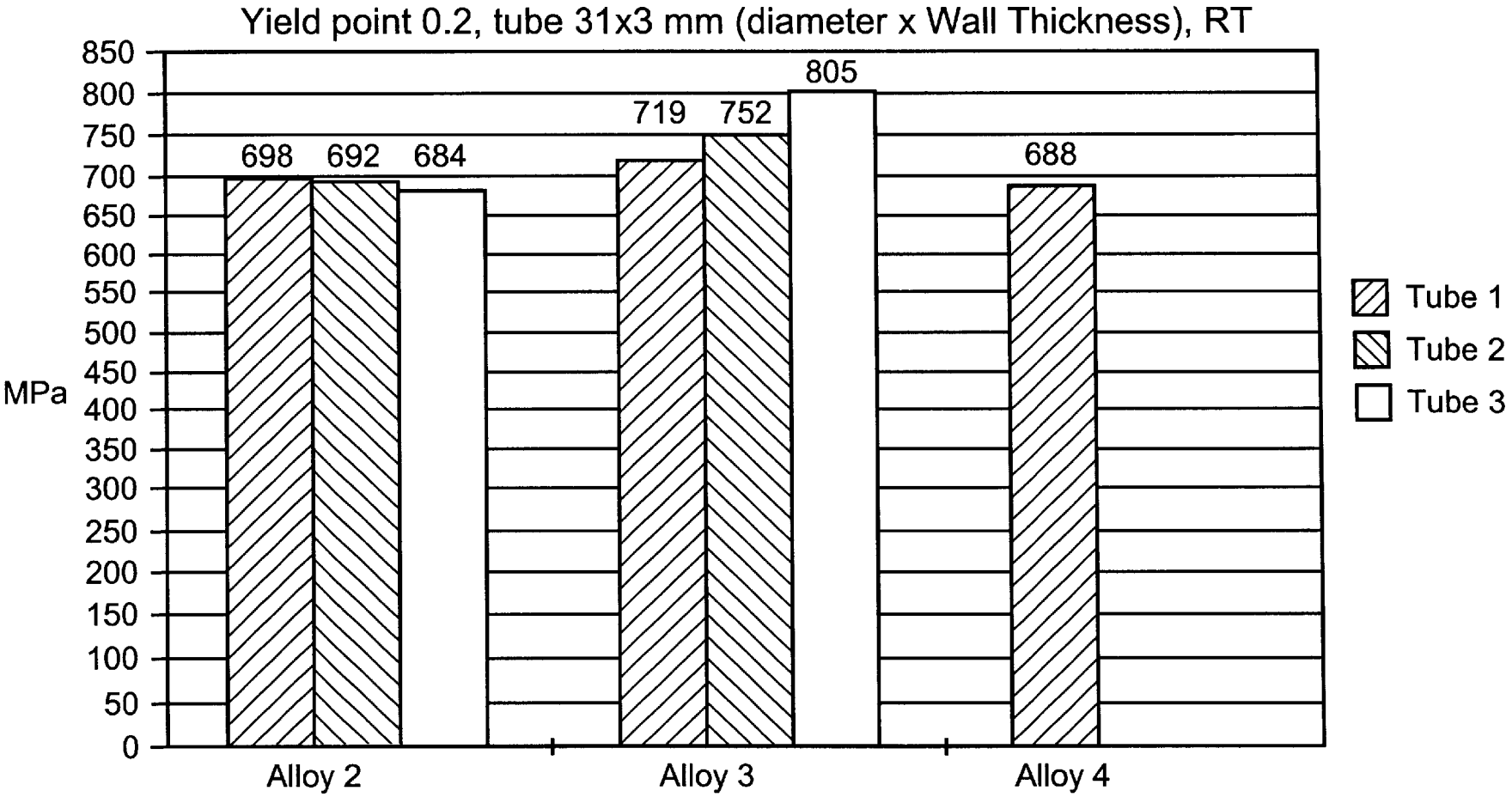
FIG. 9 is a graphical representation of the yield point for articles formed from alloys of the present invention.
Figure 10:
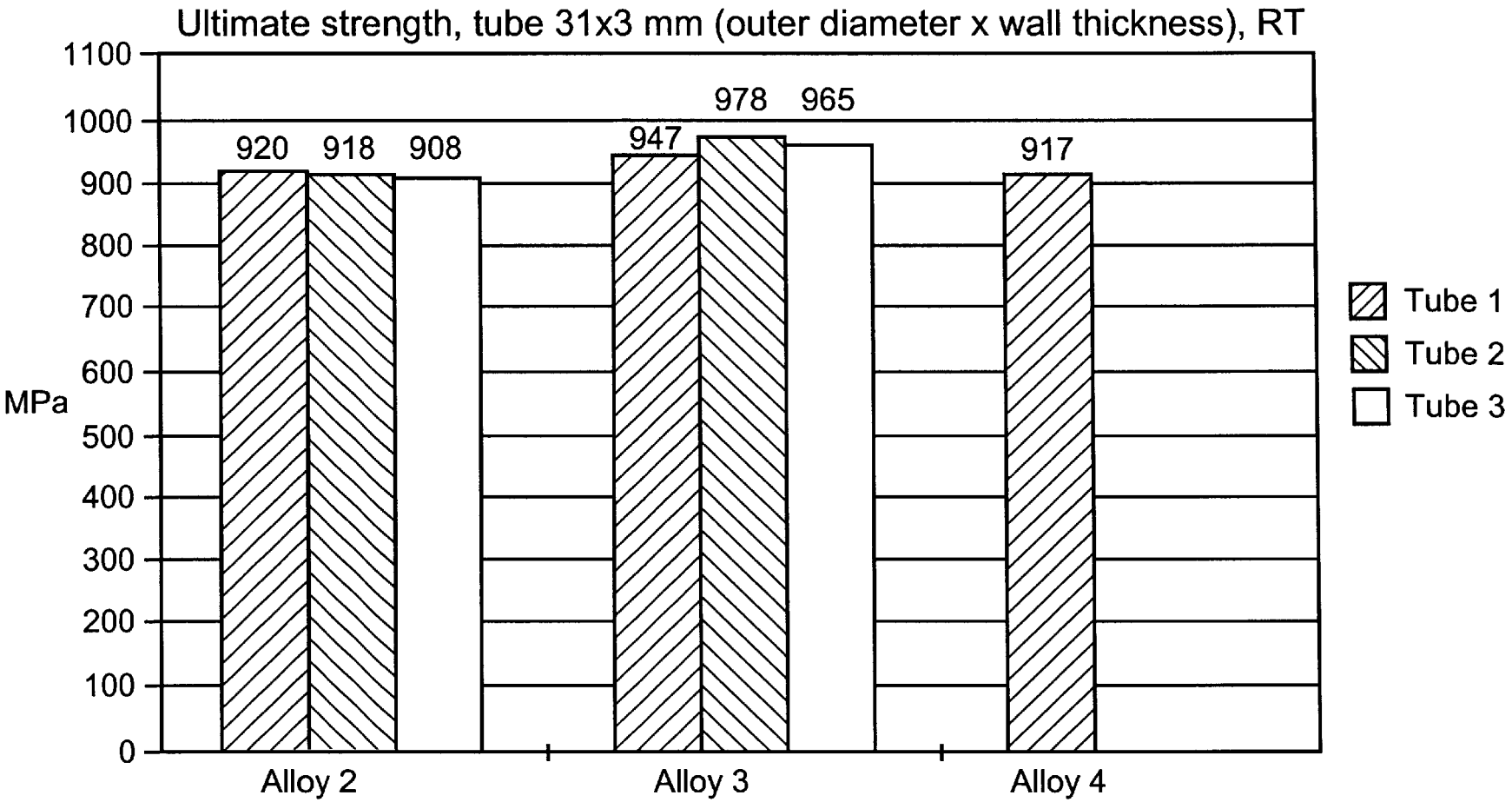
FIG. 10 is a graphical representation of the ultimate strength for articles formed from alloys of the present invention.
Figure 11:
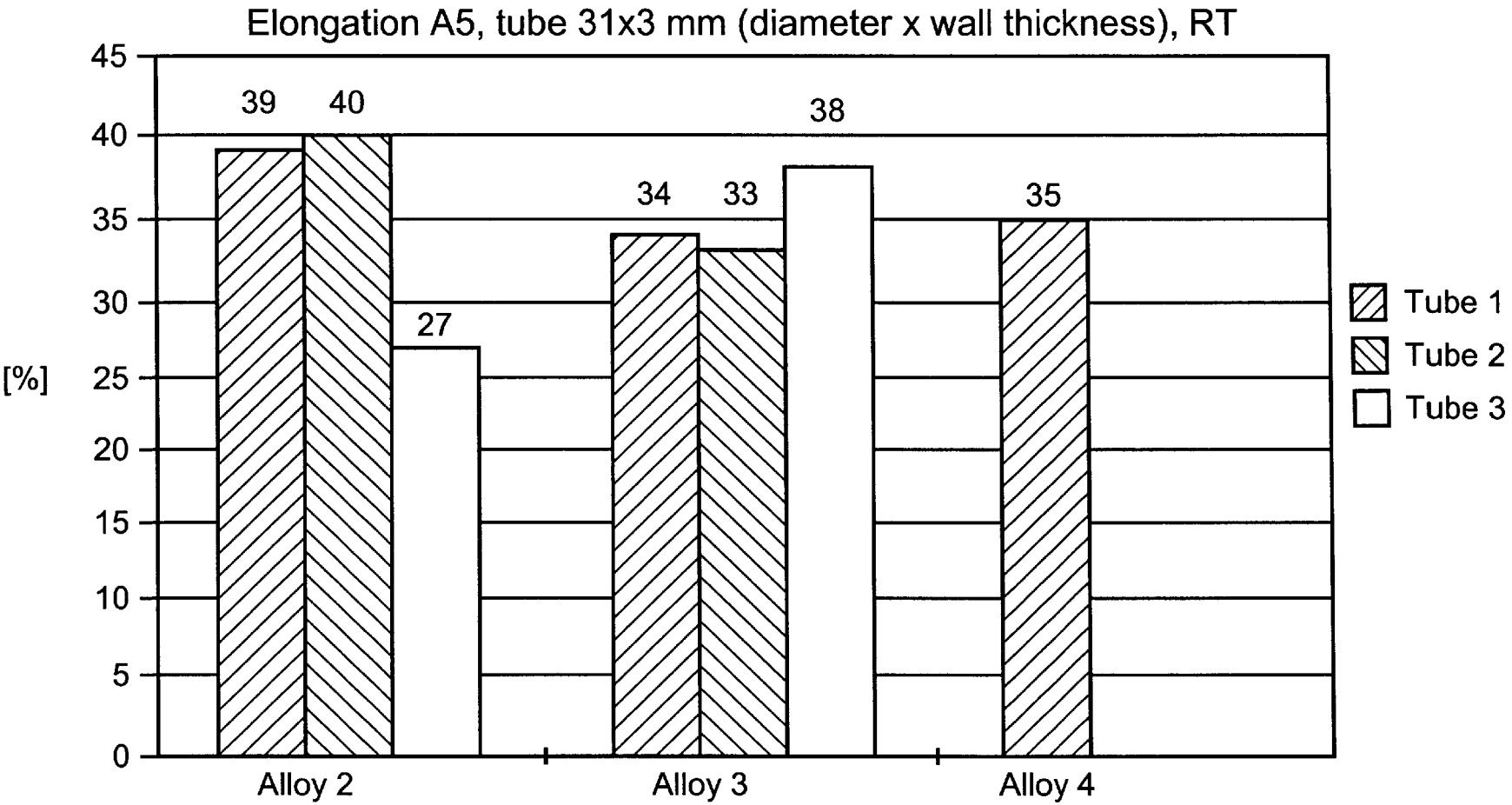
FIG. 11 is a graphical representation of the elongation for articles formed from alloys of the present invention.

The measured values for the strength of the manufactured tubes of alloy no. 2, 3 and 4 are shown in the diagrams in FIGS. 9–11. It appears that these alloys according to the invention have a yield point in tension over 650 MPa in the product application of a thin-walled tube (<10 mm), which is the general dimension used in seawater applications.

It has surprisingly been demonstrated that the steel according to the present invention is well-suited for use in seawater applications. In this regard, the steel has a yield point in tension over 650 MPa, which means that about 15% of the tubes weight could be saved compared with SAF 2507 and about 50% compared with 6Mo-steel by reducing the wall thickness. At the same time, the material has a good seawater resistance because it has a PRE-value over 40 in both phases and a high stress corrosion cracking resistance.

While the present invention has been described by reference to the above-mentioned embodiments, certain modifications and variations will be evident to those of ordinary skill in the art. Therefore, the present invention is to limited only by the scope and spirit of the appended claims.

What is claimed is:

1. A duplex ferritic-austenitic stainless steel alloy provided for seawater applications comprising, in weight %:

| | |
|---|---|
| C | maximum 0.05 |
| Si | maximum 0.8 |
| Mn | 0.3–4 |
| Cr | 28–35 |
| Ni | 3—10 |
| Mo | 1.0–4.0 |
| N | 0.2–0.6 |
| Cu | maximum 1.0 |
| W | maximum 2.0 |
| S | maximum 0.010 |
| Ce | maximum 0.2 |

and balance Fe together with normally occurring impurities and additives, wherein the ferritic content is 30–70 volume %, the alloy composition has a PRE-value higher than 42, and the PRE-value is at least 40 in both the ferritic and austenitic phases, where PRE=(% Cr)+3.3×(% Mo)+16×(% N).

2. The alloy according to claim 1, wherein the PRE-values of the ferritic and austenitic phase are approximately equal.

3. The alloy according to claim 2, wherein the alloy is heat-treated at approximately 1080° C.

4. The alloy according to claim 1, wherein the content of C is maximum 0.03 weight %.

5. The alloy according to claim 1, wherein the content of Si is maximum 0.5 weight %.

6. The alloy according to claim 1, wherein the content of Cr is between 29 and 33 weight %.

7. The alloy according to claim 1, wherein the content of Mo is at least 1.5 weight %.

8. The alloy according to claim 1, wherein the content of Mo is maximum 3.0 weight %.

9. The alloy according to claim 1, wherein the content of N is between 0.30 and 0.55 weight %.

10. The alloy according to claim 1, wherein the content of N is at least 0.36 weight %.

11. The alloy according to claim 1, wherein the content of Mn is maximum 3 weight %.

12. The alloy according to claim 1, wherein the content of ferrite is between 30 and 55 volume %.

13. The alloy according to claim 1, wherein the content of Cr in the austenitic phase is at least 25 weight %.

14. The alloy according to claim 1, wherein the content of Cr in the austenitic phase is at least 27 weight %.

15. The alloy according to claim 1, in the form of at least one of tubes, bars, heavy castings, forgings, plate, wire or strip.

16. A method comprising:

providing a duplex ferritic-austenitic stainless steel alloy with a composition comprising, in weight %:

| | |
|---|---|
| C | maximum 0.05 |
| Si | maximum 0.8 |
| Mn | 0.3–4 |
| Cr | 28–35 |
| Ni | 3—10 |
| Mo | 1.0–4.0 |
| N | 0.2–0.6 |

-continued

| | |
|---|---|
| Cu | maximum 1.0 |
| W | maximum 2.0 |
| S | maximum 0.010 |
| Ce | maximum 0.2 |

and a balance Fe together with normally occurring impurities and additives, wherein the ferritic content is 30–70 volume %, wherein the alloy composition has a PRE-value higher than 42, and the PRE-value is at least 40 in both the ferritic and austenitic phases, where PRE=(% Cr)+3.3×(% Mo)+16×(% N), forming a component with the alloy; and contacting the component with seawater.

17. The method according to claim 16, wherein the compound comprises at least one of tubes, bars, heavy castings, forgings, plates, wire or strip.

* * * * *